United States Patent [19]

Krasznai et al.

[11] Patent Number: 5,065,473

[45] Date of Patent: Nov. 19, 1991

[54] FILTER ASSEMBLY FOR A VACUUM CLEANER

[75] Inventors: Charles Z. Krasznai, Trumbull; Richard B. Kosten, West Haven, both of Conn.

[73] Assignee: Black & Decker Inc., Newark, Del.

[21] Appl. No.: 601,550

[22] Filed: Jun. 14, 1990

Related U.S. Application Data

[62] Division of Ser. No. 294,619, Jan. 9, 1989, Pat. No. 4,967,443.

[51] Int. Cl.[5] ..... A47L 5/24

[52] U.S. Cl. ..... 15/339; 15/344; 15/353

[58] Field of Search ..... 15/339, 344, 352, 353

[56] References Cited

U.S. PATENT DOCUMENTS 4,798,613 1/1989 Hetherington et al. ..... 15/344 X
4,920,608 5/1990 Hult et al. ..... 15/339

FOREIGN PATENT DOCUMENTS 2137896 10/1984 United Kingdom ..... 15/344

*Primary Examiner*—Chris K. Moore
*Attorney, Agent, or Firm*—Barry E. Deutsch

[57] ABSTRACT

The present invention is a filter assembly for a vacuum cleaner. The vacuum cleaner includes a motor, a housing enclosing the motor, and a fan driven by the motor for producing a vacuum. A canister is removably attached to the front end of the housing and has an intake nozzle for the reception of foreign matter, liquid and air drawn into the canister in response to the vacuum developed by the fan. The assembly includes a filter for filtering foreign matter from the air entering the canister. The asssembly also includes a filter housing for housing the filter. The canister includes an area of thinner material with a smoother texture than the rest of the canister to provide a generally transparent window for visually determining the amount of foreign matter within the canister.

7 Claims, 4 Drawing Sheets

FILTER ASSEMBLY FOR A VACUUM CLEANER

This is a divisional of copending application Ser. No. 07/294,619 filed on Jan. 9, 1989, now U.S. Pat. No. 4,967,443, issued Nov. 6, 1990.

BACKGROUND OF THE INVENTION

1. Field of the Invention

The present invention relates generally to portable vacuum cleaners, more particularly to, a vacuum cleaner capable of operating with both air and liquid.

2. Description of Related Art

Currently, there exists portable vacuum cleaners which pick up or vacuum solid or liquid material. These portable vacuum cleaners are frequently referred to as "wet-dry" vacuum cleaners. Typically, such vacuum cleaners include a filter assembly to filter or resist the passage of dirt through a passageway to the motor.

In the conventional wet-dry vacuum cleaner, the filter includes an integral framework formed by a plurality of ribs with a sealing flange at one end. An air permeable filter member is disposed within the framework. The filter fits within a filter housing and a sealing ring or gasket is disposed between the sealing flange of the filter and a corresponding wall or sealing portion of a filter housing to form a friction fit between the gasket, filter and filter housing.

One disadvantage of the above vacuum cleaner is that there is no provision for positively locking the filter to a filter housing. Another disadvantage is that the gasket may be dislodged during assembly of the vacuum cleaner. If this happens, liquid may leak past the gasket and contact the motor, which is undesirable. Still another disadvantage is that no guiding means exists for ensuring that a seal is properly formed between the filter, gasket and filter housing during assembly. A further disadvantage is that the filter and filter housing cannot be removed as an integral unit from the bowl for cleaning. A still further disadvantage of the above vacuum cleaner is that the operator cannot see through the canister to determine how much liquid and/or dirt is contained within the canister.

It is, therefore, one object of the present invention to provide means for ensuring that the seal is properly formed between the filter, gasket and filter housing during assembly.

It is another object of the present invention to provide means for positively locking the filter to a filter housing.

It is a further object of the present invention to provide a filter and filter housing which can be removed as one unit from the vacuum cleaner for cleaning.

It is a still further object of the present invention to provide a filter which can be removably separated from a filter housing to permit cleaning.

It is another object of the present invention to provide a means for the operator to determine the amount of liquid and/or dirt contained within the canister.

SUMMARY OF THE INVENTION

Accordingly, the present invention is a filter assembly for a vacuum cleaner. The vacuum cleaner includes a motor, a housing enclosing the motor, and a fan driven by the motor for producing a vacuum. A canister is removably attached to the front end of the housing and has an intake nozzle for the reception of foreign matter, liquid and air drawn into the canister in response to the vacuum developed by the fan. The assembly includes means for filtering foreign matter from the air and means for housing the filtering means. The assembly further includes means for removably and positively securing the filtering means to the filter housing means to allow the filtering means and the filter housing means to form an integral unit.

One advantage of the present invention is that the filter is positively locked to a filter housing by a pair of locking tabs which fit into corresponding slots on the sealing ring. Another advantage of the present invention is that alignment pins are provided to move the filter within the filter housing during assembly of the canister to the vacuum cleaner housing such that a seal is properly formed between the sealing flange of the filter assembly, gasket and the filter housing to prevent liquid from leaking past the gasket. A further advantage of the present invention is that the filter and filter housing can be removed as one unit from the vacuum cleaner for cleaning. A still further advantage of the present invention is that the filter can be removably separated from the filter housing to permit cleaning.

Other advantages of the present invention will be readily appreciated as the same becomes better understood by reference to the following detailed description when considered in connection with the accompanying drawings.

DESCRIPTION OF THE PREFERRED EMBODIMENT

Figure 1:
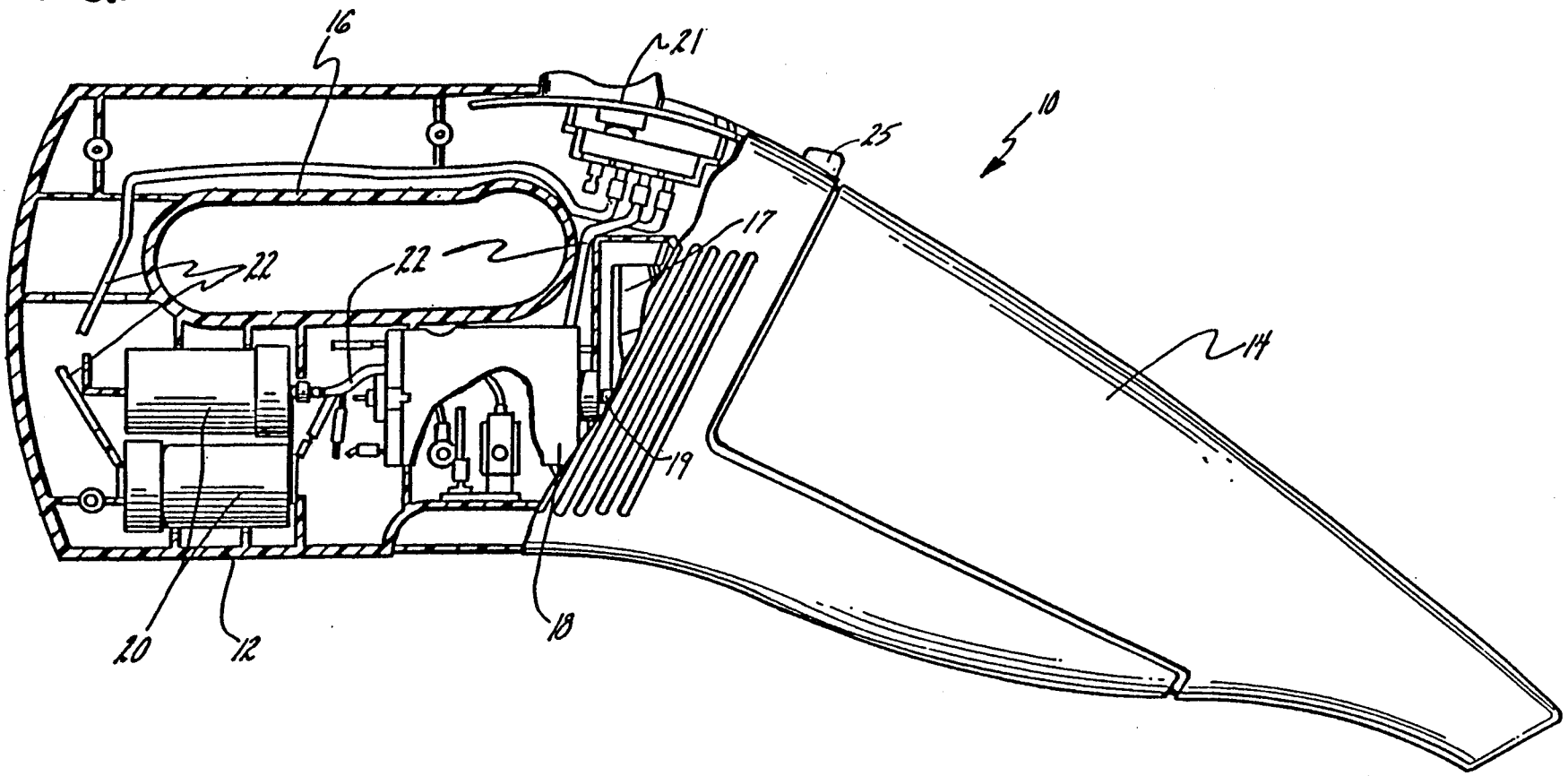
FIG. 1 is an elevational view with a rear portion broken away of a vacuum cleaner according to the present invention.

Referring to FIG. 1, a vacuum cleaner 10 incorporating the present invention is shown. The vacuum cleaner 10 comprises a central housing 12 having a canister 14 affixed to a front end thereof and a handle 16 formed near the back end thereof. The handle 16 is configured to be grasped by the hand of a person using the vacuum cleaner 10 for the cleaning of upholstery, rugs, as well as in the dusting of flat surfaces such as the top of a table.

The housing 12 contains a source of suction or fan 17 which may also be referred to as a blower or impeller, and an electric motor 18 coupled by a shaft 19 to the fan 17. Rotation of the shaft 19 by the motor 18 imparts rotation to the fan 17 to create a partial vacuum and the accompanying suction which draws air and foreign matter into the canister 14. The motor 18 is powered by a power source such as batteries 20. A switch 21 is positioned on the upperside of the handle 16 for convenient engagement by means of the thumb of a person utilizing the vacuum cleaner 10. Operation of the switch 21 provides for the coupling of electric power from the batteries 20 to the motor 18 for activation of the motor 18. Electric wiring 22 connects the batteries 20 by the switch 21 to the motor 18.

Figure 2:
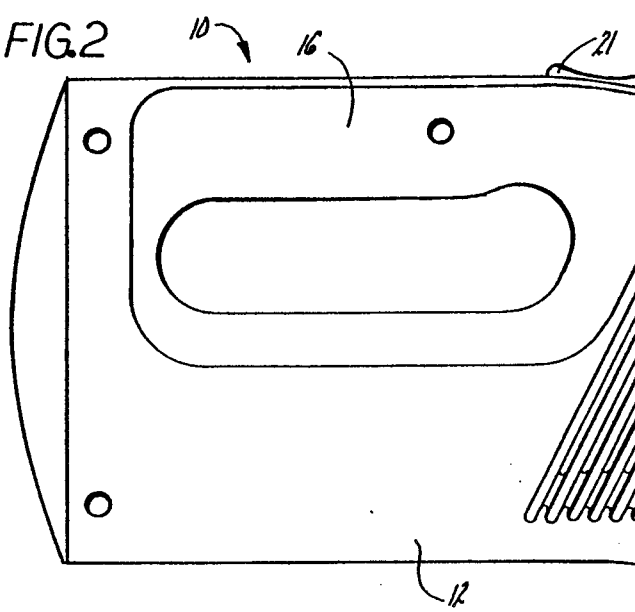
FIG. 2 is an elevational view with a front portion broken away of the vacuum cleaner of FIG. 1 incorporating the present invention.

Referring to FIG. 2, the canister 14 incorporates a nozzle 23 which opens into a storage chamber 24. The storage chamber 24 is used for the collection of any liquid and dirt which may be drawn by suction or vacuum into the vacuum cleaner 10. The canister 14 is removably attached to the forward end of the housing 12 by means of a latch member 25 or the like.

Figure 3:
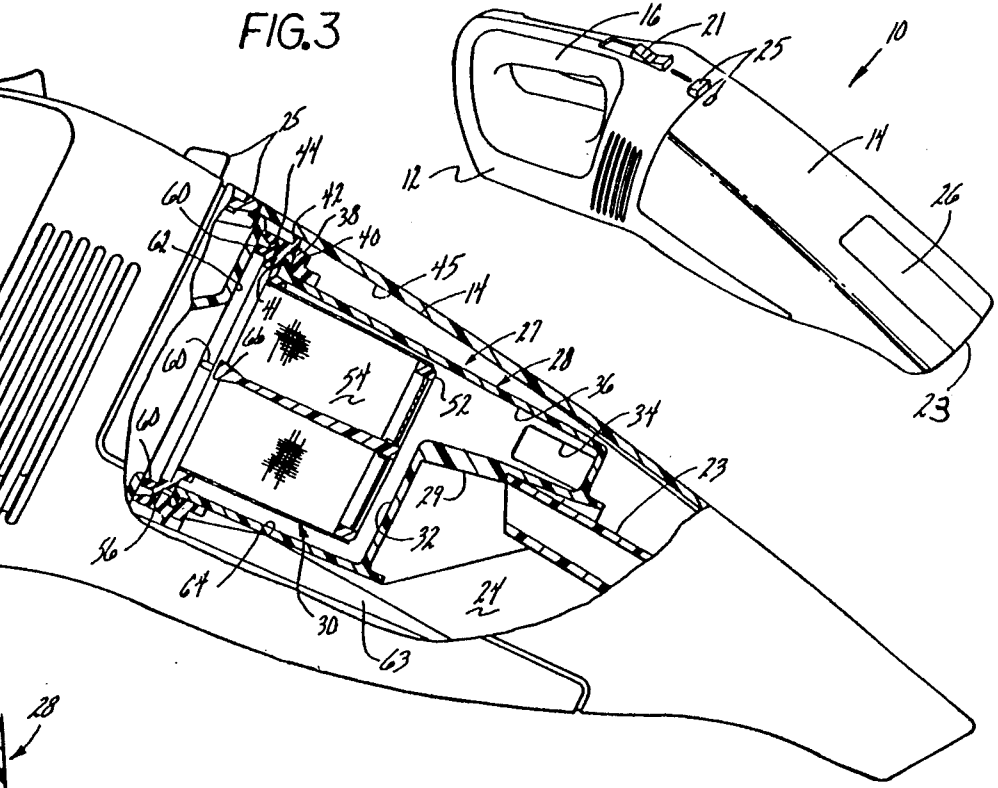
FIG. 3 is a perspective view of the vacuum cleaner of FIGS. 1 and 2.

Referring to FIG. 3, the canister 14 includes a generally rectangular window portion 26 formed on the top or upper forward surface thereof. The canister 14 has a generally opaque or cloudy appearance. The window portion 26 is substantially clear or transparent to allow the operator to visually see the liquid and/or dirt entering the storage chamber 24. The window portion 26 is formed with a wall thickness less than the wall thickness of the remaining portion of the canister 14. Preferably, the window portion 26 has a wall thickness of 1.5 mm while the remaining portion of the canister 14 has a wall thickness of 2.5 mm. Also, the window portion 26 has a high polish on both sides of its wall. The remaining portion of the canister 14 is textured and tinted in color to further provide the window portion 26 with its transparent effect.

When the vacuum cleaner 10 is in an upright operative position, the window portion 26 allows the operator to determine the amount of liquid and/or dirt in the storage chamber 24 of the canister 14. The rearward end of the window portion 26 acts as a fill line such that no further liquid and/or dirt should enter the canister 14 to prevent overfilling of the storage chamber 24.

Within the canister 14, a filter assembly 27 according to the present invention is removably disposed. The filter assembly 27 comprises a filter housing, generally indicated at 28, having a deflecting surface 29 to deflect any incoming liquid which flows from the nozzle 23 away from the flow of the air stream, and a filter, generally indicated at 30, disposed within a generally rectangular cavity 32 formed in a filter housing 28.

Figure 4:
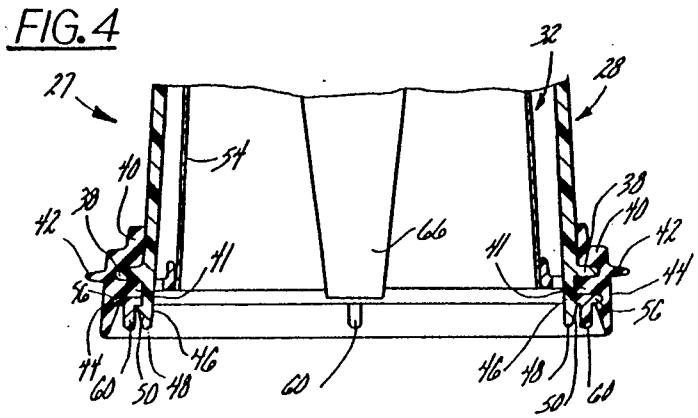
FIG. 4 is a partial sectional view of a filter assembly of FIG. 2 rotated ninety degrees.
Figure 7:
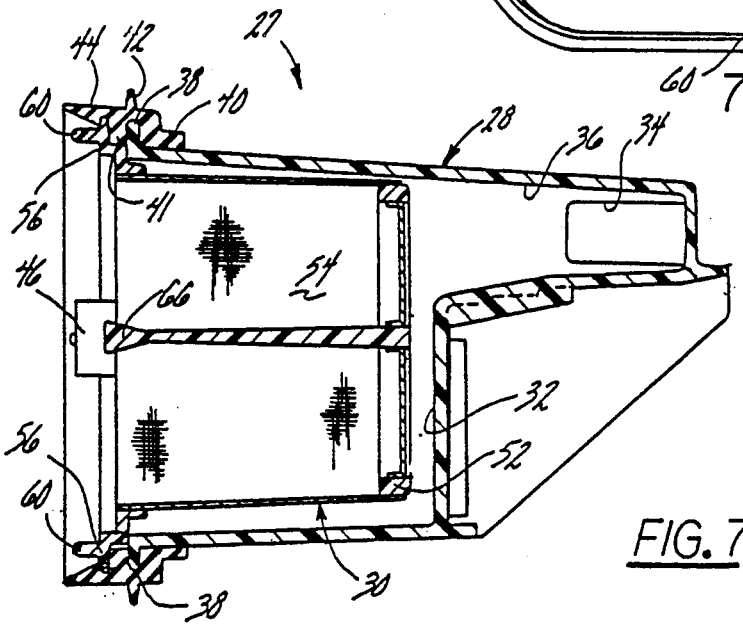
FIG. 7 is a sectional view of the filter assembly taken along line 7—7 of FIG. 6.

Referring to FIGS. 2, 4 and 7, the filter housing 28 includes openings 34 which allow the air to flow from the storage chamber 24 into the interior of the filter housing 28. The openings 34 are located at positions to prevent the flow of liquid stored in the storage chamber 24 from flowing into them. The openings 34 allow air to flow from the intake nozzle 23 into and through the fan 17. A passageway 36 is formed within the filter housing 28 and communicates with the openings 34 and the cavity 32. The filter housing 28 further includes an end flange 38 extending radially outwardly at one end or the opening of the cavity 32. A gasket or sealing ring 40 is removably molded about the end flange 40. Preferably, the gasket 40 is made of a thermo-elastic material which provides some flexibility and resiliency. The gasket 40 has an interior portion 41 extending radially inwardly to partially cover the end flange 38 of a filter housing 28. The gasket 40 also has a sealing lip 42 extending radially outwardly from its outer surface 44 which frictionally engages the interior surface 45 of the canister 14 as illustrated in FIG. 2. When the sealing flange 42 is seated against the interior surface 45 of the canister 14 when the vacuum cleaner 10 is assembled, liquid is prevented from flowing past the filter housing 28 to the fan 17.

Referring to FIGS. 4 and 7, the filter housing 28 also includes a pair of locking tabs 46 extending axially outwardly from the end flange 38. One of the locking tabs 46 is disposed on one side of the cavity 32 and the other locking tab 46 is disposed on the other side of the cavity 32. The locking tabs 46 are integrally formed with the end flange 38, both of which are made of a plastic material having some flexibility and resiliency. The free end 48 of the locking tabs 46 includes a protrusion 50 extending radially outwardly.

Figure 5:
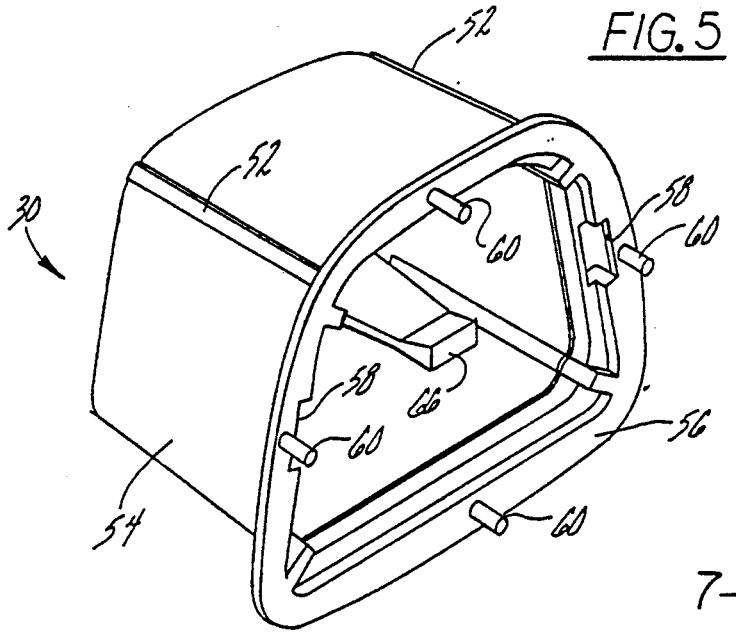
FIG. 5 is a perspective view of the filter assembly of FIG. 2.
Figure 6:
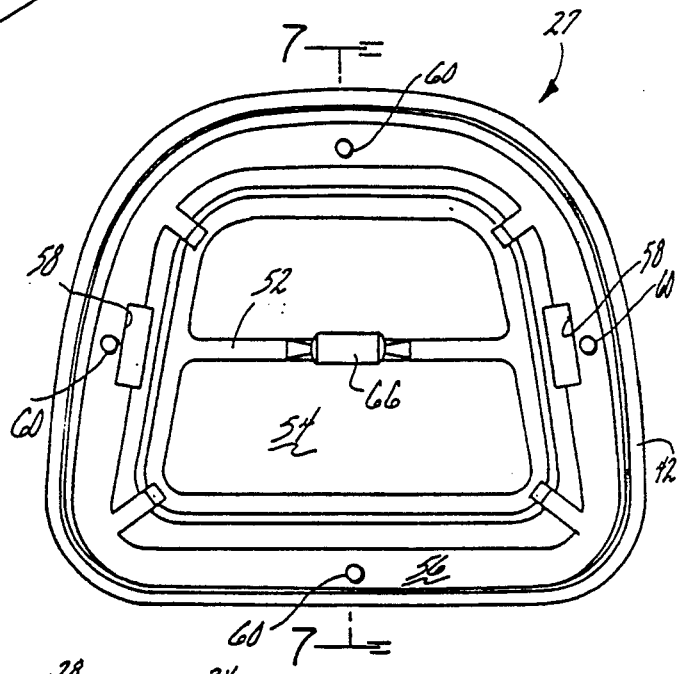
FIG. 6 is an elevational view of the filter assembly of FIG. 2.

Referring to FIG. 5, the filter 30 comprises a generally rectangular framework 52 made from a plurality of interconnected ribs. An air permeable filter member 54 is disposed within the framework 52 and secured thereto. The filter 30 also includes a sealing flange 56 extending radially outwardly from one end or the opening of the framework 52. A pair of slots 58 are formed in the sealing flange 56 of the filter 30 and aligned with the locking tabs 46 of the filter housing 28 such that the locking tabs 46 may be disposed in the slots 58 when the sealing flange 56 seats against the gasket 40 to removably and positively secure the filter 30 to the filter housing 28 to allow the filter 30 and filter housing 28 to form an integral unit.

The filter 30 further includes a plurality of alignment posts or pins 60 extending axially outwardly from the sealing flange 56. Preferably, there is an alignment pin 60 for each side of the sealing flange 56. The alignment pins 60 contact a front face 62 of the housing 12 during assembly as illustrated in FIG. 2.

Figure 8:
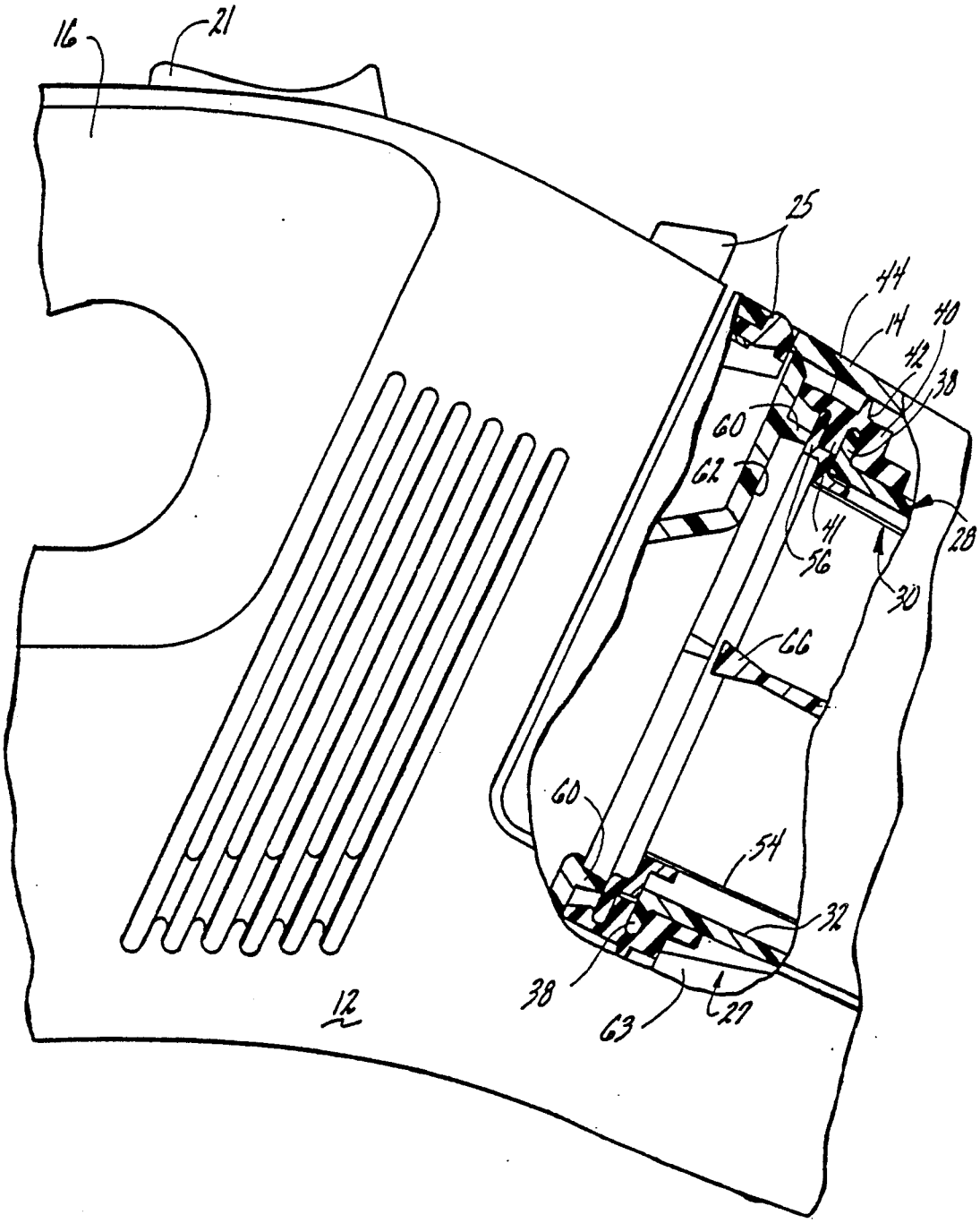
FIG. 8 is an enlarged partial elevational view with a portion broken away of an alternate embodiment of the filter assembly.

Referring to FIG. 8, an alternate embodiment of the filter assembly 27 is shown. Preferably, the alignment pins 60 are formed on the front face 62 of the housing 12 and extend axially outwardly toward the filter 30. It should be appreciated, however, that the alignment pins 60 may be formed as "bumps" or protrusions on the front face 62 of the housing 12.

Referring to FIGS. 2 and 8, the canister 14 includes a pair of laterally spaced locator ribs 63 which operatively coact with the filter housing 28 to prevent the filter housing 28 from being "pushed" or moved too far within the canister 14 toward the nozzle 23. The locator ribs 63 have a generally inverted "V" shaped configuration to form a point 64 which engages the filter housing 28 and resists or prevents further movement of the filter housing 28 inwardly into the canister 14.

If the filter housing 28 and filter 30 are disposed within the canister 14, when canister 14 is attached to the housing 12, the alignment pins 60 will move the filter 30 and filter housing 28 inwardly into the canister 14 until the locator ribs 63 prevent further movement of the filter housing 28. The filter 30 continues to move within the cavity 32 of a filter housing 28 until the locking tabs 46 are disposed in the slots 58 of the sealing flange 56 to ensure that a proper seal is formed between the sealing flange 56 of the filter 30, interior portion 41 of the gasket 40 and end flange 38 of the filter housing 28. Additionally, if the filter 30 is secured to the filter housing 28 prior to assembly, the alignment pins 60 will move the filter assembly 27 until positively located or stopped by the locator ribs 63 to properly seat the gasket 40 such that the sealing lip 42 frictionally engages the interior surface 45 of the canister 14.

The filter 30 also includes a pull tab member 66 extending axially outwardly from the bottom of the framework 52. The pull tab member 66 is adapted to be grasped by the thumb and forefinger of a person and pulled axially to deflect the locking tabs 46 and separate the filter 30 from the filter housing 28 to permit removal of the filter 30 for cleaning or the like.

In operation, during assembly of the vacuum cleaner 10, the locking tabs 46 are deflected radially inwardly and disposed in the slots 58 of the sealing flange 56. Once the protrusion 50 is past the sealing flange 56, the locking tabs 46 return to their original undeflected position to prevent separation between the filter 30 and filter housing 28. The sealing flange 56 abuts the interior portion 41 of the gasket 40. The filter 30 is removeably and positively secured to the filter housing 28 such that the two form an integral unit or assembly 27. The filter assembly 27 is placed within the canister 14. The canister 14 is removably secured to the housing 12. When this occurs, the alignment pins 60 slides the filter assembly 27 within the canister 14 until located or stopped by the locator ribs 63. When the canister 14 is finally secured in place to the housing 12, the sealing lip 42 of the gasket 40 frictionally engages the interior surface 45 of the canister 14.

The present invention has been described in an illustrative manner. It is to be understood that the terminology which has been used is intended to be in the nature of words of description rather than of limitation.

Obviously, many modifications or variations of the present invention are possible in light of the above teachings. Therefore, within the scope of the appended claims, the present invention may be practiced otherwise than as specifically described.

What is claimed is:

1. A vacuum cleaner comprising:

a motor;

a housing enclosing said motor;

a fan driven by said motor for producing a vacuum;

a canister formed from a material that is given physical characteristics that render the canister generally opaque, said canister being removably attached to a front end of said housing for reception of foreign matter, and air driven into said canister in response to the vacuum developed by said fan; and means for visually determining the amount of foreign matter within said canister, said means comprising a window on an upper surface of said canister, said window being formed integrally of said material with said canister, said material of said window being given physical characteristics that render said window generally transparent.

2. A vacuum cleaner as set forth in claim 1, wherein said canister has a wall thickness, the wall thickness of said window being less than the wall thickness of the remaining portion of said canister.

3. A vacuum cleaner as set forth in claim 1, wherein the material forming said window is shaped generally rectangularly.

4. A vacuum cleaner as set forth in claim 3, wherein the material forming said window has a high polish on both sides of its wall.

5. A vacuum cleaner as set forth in claim 4, wherein the portion of said canister excluding said window is textured and tinted in color to provide the window with its transparent effect.

6. A vacuum cleaner as set forth in claim 1, wherein the material forming said window has a high polish on both sides of its wall.

7. A vacuum cleaner as set forth in claim 6, wherein the portion of said canister excluding said window is textured and tinted in color to provide the window with its transparent effect.

* * * * *